United States Patent [19]

Yamashita

[11] Patent Number: 4,841,830

[45] Date of Patent: Jun. 27, 1989

[54] FOLDABLE ELECTRONIC BASS DRUM

[75] Inventor: Toshinori Yamashita, Hamamatsu, Japan

[73] Assignee: Yamaha Corporation, Hamamatsu, Japan

[21] Appl. No.: 112,897

[22] Filed: Oct. 23, 1987

[30] Foreign Application Priority Data

Oct. 23, 1986 [JP] Japan ..... 61-161531[U]

[51] Int. Cl.[4] ..... G10H 3/14; G10D 13/02

[52] U.S. Cl. ..... 84/1.14; 84/422.1; 84/412; 84/DIG. 12

[58] Field of Search ..... 84/1.03, 1.04, 1.06, 84/1.14, 411 R, 422 R, 422 S, DIG. 12, 327, DIG. 3, 422.1, 422.2, 412; 248/188.5, 188.6, 188.7

[56] References Cited

U.S. PATENT DOCUMENTS

| | | | |
|---|---|---|---|
| 1,501,278 | 7/1924 | Danly | 84/422.2 |
| 4,200,025 | 4/1980 | Currier | 84/422 R |
| 4,581,972 | 4/1986 | Hoshino | 84/1.14 |
| 4,679,479 | 7/1987 | Koyamoto | 84/1.04 |
| 4,732,070 | 3/1988 | Yamashita | 84/422.1 X |

*Primary Examiner*—A. T. Grimley
*Assistant Examiner*—Matthew S. Smith
*Attorney, Agent, or Firm*—Blakely, Sokoloff, Taylor & Zafman

[57] ABSTRACT

A foldable electronic bass drum includes a base to be placed on a floor surface with a coupling device provided at a portion of the base for coupling a foot pedal with a beater. On a portion of the base remote from the coupling device, an arm mounting a pad to be struck by the beater at one end of the arm and an arm supporting device for pivotally supporting the other end of the arm are provided. The other end of the arm is fixed to the base by a fixing device so that the beater of the foot pedal can strike the pad. A vibration of the pad is picked up by a pick up device for converting a vibration of the pad into an electrical signal. When the foldable electronic bass drum is not used, the arm is released from the fixing device so that the arm is moved forward the foot pedal and laid on the base thereby establishing conveyance.

2 Claims, 2 Drawing Sheets

FOLDABLE ELECTRONIC BASS DRUM

BACKGROUND OF THE INVENTION

The present invention relates to a foldable electronic bass drum played by a foot pedal.

A foldable electronic bass drum is played by a foot pedal. That is, a pad is struck by a beater which is pivoted in association with a stamping operation of a foot board, and a vibration caused thereby is converted into an electrical signal. A musical tone (electronic tone) generating operation of an electronic tone source (e.g., a PCM tone source or an FM tone source) is controlled by waveform information (striking position as a function of time, tone volume, and the like) of the electrical signal, thereby generating an electronic tone from a loudspeaker. A foldable electronic bass drum is constituted by a frame, generally formed to be a substantially L-shape, and placed on a floor surface, a pad disposed at an upper end portion of the frame through a holder, a pickup device disposed on the rear surface of the pad, and the like. A front end portion of the frame, i.e., a side edge portion thereof near a performer is clamped by a clamp mechanism of the foot pedal.

However, since the frame is substantially L-shaped, a conventional foldable electronic bass drum having the above arrangement cannot be easily carried and requires a large housing space.

SUMMARY OF THE INVENTION

It is, therefore, a principal object of the present invention to provide a foldable electronic bass drum which can be easily carried and housed without requiring a large space.

According to an aspect of the present invention, there is provided a foldable electronic bass drum comprising: a base to be placed on a floor surface; a coupling device, provided at a portion of the base, for coupling a foot pedal having a beater with the base; a pad to be struck by the beater; an arm for mounting the pad at one end thereof; an arm support device, provided on a portion of the base remote from the coupling device, for pivotally supporting the arm; a fixing device for fixing the other end of the arm to the base so that the beater can strike the pad, the arm being moved toward the foot pedal and laid on the base when the arm is released from the fixing device; and a pickup device for converting a vibration of the pad into an electrical signal when the pad is struck by the beater.

DESCRIPTION OF THE PREFERRED EMBODIMENT

An embodiment of the present invention will be described in detail with reference to the accompnaying drawings.

Figure 1:
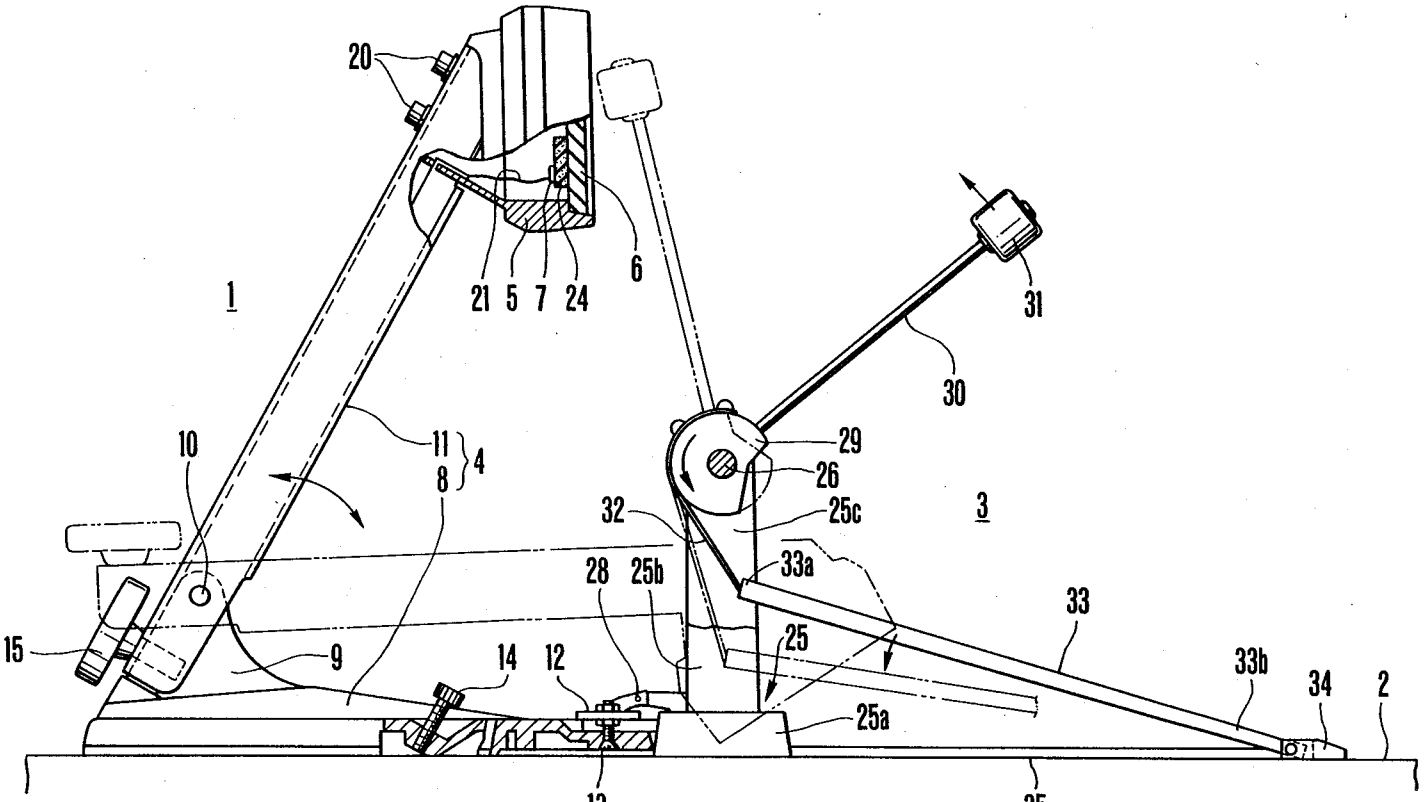
FIG. 1 is a partially cutaway side view of an embodiment of a foldable electronic bass drum according to the present invention.
Figure 2:
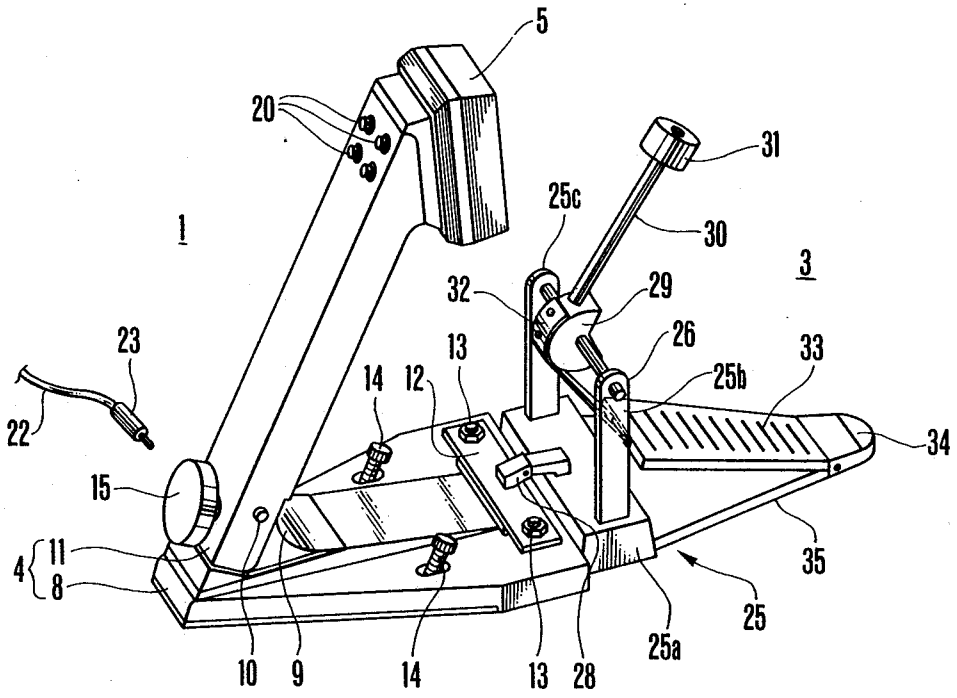
FIG. 2 is a perspective view of the drum shown in FIG. 1.

FIG. 1 is a partially cutaway side view of an embodiment of a foldable electronic bass drum according to the present invention, and FIG. 2 is a perspective view of the drum shown in FIG. 2. In FIGS. 1 and 2, a foldable electronic bass drum 1 includes: a frame 4, placed on a floor surface 2, and coupled to a foot pedal 3; a pad holder 5 mounted on the upper end of the frame 4; a pad 6, formed of, e.g., rubber, and disposed to the holder 5 so as to close a front surface opening portion thereof; and a pickup device 7, fixed on a proper portion of the rear surface of the pad 6, for picking up a vibration of the pad 6 and converting it into an electrical signal.

The frame 4 has a base 8, formed to be a substantially flat plate, and placed on the floor surface 2, and an arm 11, a lower end portion of which is supported through a shaft 10 to be pivotal in a forward/backward direction by a bearing portion 9 projecting from the upper surface of a rear end portion of the base 8, and hence which can be folded in the forward/backward direction. A clamp plate 12 is disposed on the upper surface of a front end portion of the base 8, i.e., a side edge portion thereof near a performer so that a height thereof can be arbitrarily adjusted by a pair of set bolts 13, thereby constituting a coupling portion with respect to the foot pedal 3. A pair of set screws 14 are respectively screwed into both edge portions of the upper surface of the base 8 to be brought into contact with the floor surface 2. By changing a screwed amount of the set screws 14, an angle of the base 8 with respect to the floor surface 2 can be adjusted. A fixing bolt 15 as a fixing means for fixing the arm 11 at a performance position inclined forward through a predetermined angle is threadably engaged in the rear surface of the bearing portion 9. When the fixing bolt 15 is tightened, the rear surface of a lower end portion of the frame 11 is urged against and fixed to the rear surface of the bearing portion 9. An insertion hole or an elongated groove (neither of which are shown) in which a male screw portion of the bolt 15 is inserted is formed at the lower portion of the rear surface of the frame 11. The pad holder 5 is fixed to an upper end portion of the frame 11 by set screws 20 so that its opening portion faces a performer, and hence, the foot pedal 3. One end of a lead wire 21 is connected to the pickup device 7, and the other end thereof is connected to a connector (not shown) provided in the arm 11 through the interior of the pad holder 5. One end of a cord 22, the other end of which is connected to an electronic tone source apparatus (not shown), is connected to the connector through a plug 23. A cushion member 24 for adjusting the sensitivity of the pickup device 7 is interposed between the pad 6 and the pickup device 7.

The foot pedal 3 is of conventionally known type, and includes a base portion **25*a* placed on the floor surface 2, and a substantially inverted U-shaped frame 25 consisting of a pair of posts 25*b* and 25*c*, respectively projecting from both sides of the upper surface of the base portion 25*a*, for rotatably supporting a pivoting shaft 26 between their upper ends. A clamp mechanism 28 for clamping the clamp plate 12 is disposed at a central portion of the upper surface of the base portion 25*a*. A rocker 29 is fitted on a central portion of the pivoting shaft 26. A beater rod 30 is mounted on the outer surface of the rocker 29 to be inclined forward through a predetermined angle. A beater 31 for striking the pad 6 is fixed at the distal end of rod 30. One end of a flexible strap 32 is screwed to the surface of the rocker 29, and the other end thereof extends downward and is coupled to a rear end 33*a* of a foot board 33. Since the rear end 33*a* is coupled to the strap 32, the rear end of the foot board 33 is normally kept floated from the floor surface 2, and a front end 33*b* thereof is pivotally coupled to a heel 34. The heel 34 is placed on the floor 2 and is coupled to the base portion 24***a* by a coupling rod 35.

The foldable electronic bass drum 1 having the above arrangement, when the foot board 33 is stamped, the strap 32 is pulled up so that the pivoting shaft 26 is pivoted counterclockwise in FIG. 1. Then, since the rocker 29 is pivoted integrally with the pivoting shaft 26, the beater 31 is pivoted from the back to strike the surface of the pad 6, i.e., the surface to be struck. A vibration of the pad 6 is converted into an electrical signal by the pickup device 7. The electrical signal is input to the electronic tone source apparatus through the cord 22.

According to the arrangement of the above embodiment, when the fixing bolt 15 is removed while the foot pedal 3 is detached from the base 8, the arm 11 is pivoted forward and is folded as shown by an alternate long and short dashed line in FIG. 1. Therefore, the foldable electronic bass drum of the present invention can be easily carried and housed in a small space. In the above embodiment, since a width of the front end of the base 8 is set as large as that of the base portion 25*a*, good stability of the frame 4 can be obtained, thereby reducing a vibration of the frame 4 generated when it is struck with the beater 31. In addition, since a height of the clamp plate 12 can be adjusted by the pair of set screws 13, the present invention can be applied to various foot pedals having different mounting heights of the clamp mechanism 28.

As has been described above, in the foldable electronic bass drum according to the present invention, the frame of the foldable electronic bass drum is constituted by the base placed on the floor surface and the arm disposed on the base to be freely folded, and hence can be made compact during transportation. Therefore, the foldable electronic bass drum can be easily carried and housed in a small place.

What is claimed is:

1. A foldable electronic drum comprising:

a base adapted to be placed on a floor, said base having first and seconds ends;

a support arm pivotally mounted on said first end of said base;

a pad mounted on said support arm;

coupling means mounted on said second end of said base for movably coupling a beater to said base such that said beater may strike said pad;

restraining means connected to said support arm for fixing the position of said arm with respect to said base when said restraining means is engaged, and allowing said arm to move toward said base when said restraining means is disengaged, thereby folding said drum; and a pickup device connected to said pad for converting a vibration of said pad into an electrical signal when said pad is struck by said beater.

2. A drum according to claim 1 wherein said pad is fixed at one end of said support arm through a pad holder.

* * * * *